US011242709B1

(12) United States Patent
Hay, III

(10) Patent No.: US 11,242,709 B1
(45) Date of Patent: Feb. 8, 2022

(54) DRAINAGE SYSTEM FOR A WINDOW AND THE LIKE

(71) Applicant: Hawkes Design and Consulting, LLC, Charleston, SC (US)

(72) Inventor: Henry M. Hay, III, Charleston, SC (US)

(73) Assignee: HAWKES DESIGN AND CONSULTING, LLC, Charleston, SC (US)

( * ) Notice: Subject to any disclaimer, the term of this patent is extended or adjusted under 35 U.S.C. 154(b) by 0 days.

(21) Appl. No.: 16/869,178

(22) Filed: May 7, 2020

(51) Int. Cl.

| | |
|---|---|
| ***E06B 7/14*** | (2006.01) |
| ***E06B 7/22*** | (2006.01) |
| ***E06B 7/23*** | (2006.01) |
| *E06B 7/16* | (2006.01) |
| *E06B 7/205* | (2006.01) |

(52) U.S. Cl.
CPC ..... *E06B 7/14* (2013.01); *E06B 7/23* (2013.01); *E06B 7/16* (2013.01); *E06B 7/205* (2013.01); *E06B 7/22* (2013.01)

(58) Field of Classification Search
CPC ..... E06B 2001/628; E06B 1/702; E06B 3/56; E06B 2007/145; E06B 7/16; E06B 7/205; E06B 7/22; E06B 7/23; E06B 7/2305; E06B 7/2312; E06B 7/56
See application file for complete search history.

(56) References Cited

U.S. PATENT DOCUMENTS

| | | | | |
|---|---|---|---|---|
| 3,638,372 | A * | 2/1972 | Rosenthal | E06B 7/14 52/97 |
| 4,065,884 | A * | 1/1978 | Tenquist | E06B 7/14 52/171.3 |
| 4,608,796 | A * | 9/1986 | Shea, Jr. | E06B 1/36 52/204.595 |
| 5,706,607 | A * | 1/1998 | Frey | E06B 1/70 49/478.1 |
| 6,190,751 | B1 * | 2/2001 | Sylvester | C09J 7/29 428/66.4 |
| 6,451,398 | B1 * | 9/2002 | Sylvester | C09J 7/29 428/41.8 |
| 10,400,501 | B1 * | 9/2019 | Tatley | E06B 3/06 |
| 2002/0139060 | A1 * | 10/2002 | Contreras | E04F 13/0889 52/101 |
| 2003/0221381 | A1 * | 12/2003 | Ting | E06B 1/36 52/204.1 |
| 2006/0080902 | A1 * | 4/2006 | Bren | E06B 1/58 52/58 |

(Continued)

*Primary Examiner* — Phi D A
(74) *Attorney, Agent, or Firm* — Bryan L. Baysinger; Nexsen Pruet, LLC

(57) ABSTRACT

In an extruded window frame, engineered foam patches are attached to the window frame for delivery to the job site. In combination with a sealant bead that is applied at the job site to the perimeter of the nail fin on the window frame, the foam patches serve as weep holes. Moisture reaching the interior of the rough framed opening of the building after installation of the windows is channeled between the sealant bead and the inside of the window frame. The foam patches, applied as a spaced-apart pair to the inside surface of the nail fin are in physical contact with the sealant bead to receive channeled rainwater, which can flow by gravity to the bottom of the window frame and exit the window. The foam patches block entry of insects.

8 Claims, 3 Drawing Sheets

(56) References Cited

U.S. PATENT DOCUMENTS

| | | | | |
|---|---|---|---|---|
| 2006/0143996 | A1* | 7/2006 | Alvarado | E06B 1/02 52/204.53 |
| 2006/0236618 | A1* | 10/2006 | Williams | E06B 1/702 52/58 |
| 2007/0056230 | A1* | 3/2007 | Bren | E04B 1/66 52/204.1 |
| 2008/0116707 | A1* | 5/2008 | Boaz | B60J 10/00 296/26.01 |
| 2008/0229677 | A1* | 9/2008 | McCoy | E06B 1/62 52/58 |
| 2010/0170186 | A1* | 7/2010 | Hohmann, Jr. | B32B 7/06 52/741.4 |
| 2012/0186665 | A1* | 7/2012 | Vos | E06B 1/68 137/343 |
| 2014/0041326 | A1* | 2/2014 | Kadavy | E06B 7/14 52/209 |
| 2014/0318035 | A1* | 10/2014 | Costa | E06B 1/342 52/62 |
| 2014/0331579 | A1* | 11/2014 | Evensen | E04B 2/96 52/204.593 |
| 2015/0240483 | A1* | 8/2015 | Riepe | E04B 1/4178 52/309.12 |
| 2017/0002599 | A1* | 1/2017 | Thompson | E06B 7/14 |
| 2019/0352958 | A1* | 11/2019 | Albrecht | E06B 3/4415 |

* cited by examiner

DRAINAGE SYSTEM FOR A WINDOW AND THE LIKE

TECHNICAL FIELD

This disclosure relates generally to windows and the like, and, more specifically to the draining of water, such as rainwater, from a window frame or any product placed into a building opening specifying a non-continuous sealant bead.

BACKGROUND

To make a penetration in a building, for example, for a window, a rough opening is made in the wall for a window frame to be secured to the wall surrounding that opening. The installation of the window should be done so as to allow rain that falls on the building and on the window to be shed and be prevented from entering the interior of the building, especially from entering the inside of the walls of the building. Water that penetrates is ideally returned to the exterior of the building through "weep holes."

In addition to building penetrations for windows, they are also made for a packaged terminal air conditioner, a hose bib, electrical junction boxes, dryer vents, flush lighting fixtures, and exhaust vents. Each penetration may require a frame that needs to be sealed against water intrusion in a similar manner.

Weep holes in general are pathways provided in a structure to enable water that enters an opening in the structure to drain to the outside of the structure. Windows fabricated of extruded polyvinyl chloride components are made with weep holes. As long as the weep-holes are periodically serviced, they perform well. Nonetheless, the window frame may still admit some water, for example, the area outside the window frame, between the window frame and the wall, can become a source of water intrusion that should be routed back to the exterior.

A window frame is fitted to a hole made for it, sometimes called a "rough opening", in the wall of the building. The edges of the rough opening are covered with water-repellant cover flashing tape to seal the walls and window surfaces at the rough opening from water intrusion.

The extruded vinyl window frame to be installed in the rough opening may include a lateral flange or "nail fin" on its perimeter that extends from the window frame over the sides of the hole in the wall to cover the marginal edge of the hole for the window and to serve as a broad surface for engaging the wall and for facilitating the fastening and sealing the window to the building.

The nail fin is fastened to the wall and water-proof flashing tape is applied over it. Before it is fastened, however, a water-proof sealant may be applied in the form of a bead under the nail fin, on the surface that will engage the exterior wall of the house around the rough opening. Other structures may be added to the exterior, such as flashing and drip guards to help prevent the intrusion of water into the window or into the wall that holds the window structure to the exterior.

One type of weep hole common in the installation of windows is made by leaving gaps in the sealant bead as it is being applied to the bottom of the nail fin. The sealant limits lateral movement of water from behind the window. At the gaps in the sealant, the otherwise confined water can fall to the bottom of the fin and drain to the outside of the building. This rainwater moves by gravity and surface tension down to the bottom of the nail fin following the sealant bead toward the "weep holes" (gaps in the sealant) and then to the exterior of the building, and in response to gravity.

These weep holes trap insects and debris, which, in time, limit or block the escape of the water from the window. Furthermore, the gaps in the sealant bead may not be uniform and some may be too narrow, especially if the sealant has spread because of the pressure applied to the nail fin on installation. Accordingly, gaps left in the sealant are not always effective "weep holes" for shedding water and may in time become clogged by insects and dirt. These weep holes may in fact admit water when subjected to required post-installation, industry-approved water penetration tests. During such a test, the weep hole or pathway for water removal may act as an entry point for water.

Thus, there remains a need for a better way to make a window that reliably prevents insect infestation and sheds rainwater, particularly in geographic areas that are prone to rainy weather and especially to driving rains.

SUMMARY

According to its major aspects and briefly recited, the present system is a window frame with a nail fin in combination with a sealant bead and at least one thin, open-cell foam patch with open edges and an adhesive on its broad sides that is then covered with a protective, peelable cover over the adhesives on both broad sides. The foam patches may be rectangular, and are positioned on the bottom, wall-facing side of the nail fin of the window frame so the foam patch adheres to the nail fin and is against inside of the wall of the building where it can receive channeled rainwater otherwise trapped behind the window frame, including water trapped in the window frame.

The foam patches, preferably two spaced-apart foam patches, are immediately adjacent to the ends of the sealant bead that is applied around the sides and top of the nail fin so as to limit the intrusion of the water and confine the water so it must run to the bottom of the window frame, constrained along its way by the sealant bead on the fin and water-proof cover, until the water reaches the open cells of the two spaced-apart foam patches at the bottom of the nail fin. From there it proceeds directly to the outside of the building.

The foam patch with its protective cover thus constitutes an engineered weep hole that readily wicks moisture from inside the perimeter defined by the sealant bead and carries it to the exterior of the building. The open cell foam of the foam patch will block the path of insects, such as bees, wasps, gnats, and flies, that may otherwise attempt to enter the window frame and the building. The protective cover and foam block the sealant from entering the foam.

The use of open-cell foam is an aspect of the disclosure. Open cell foam wicks water into the weep hole while also serving as a physical barrier against the intrusion of insects. The open-cell foam may be made of a plastic that is inexpensive and capable of remaining as an effective barrier to insects over long periods of time.

Another aspect of the present device is that the foam patches can be provided as part the window frame by the manufacturer in contrast to the prior art method of entrusting the installer with the task of leaving gaps of the right size and right locations in the sealant bead for the weep holes. The present weep holes, in sharp contrast with the prior art, can be designed and manufactured to specification, and then properly positioned, oriented and securely adhered to a window frame, and thus provide a uniform (as to position, dimensions, and materials) weephole, just as the balance of the window itself is precision engineered and manufactured according to its engineered design, rather than being left for the ad hoc approach of the jobsite. The foam patches in place on the window frames that arrive at the jobsite also establish where the sealant bead starts and stops, so, it defines the end points of the sealant bead which are determined by the engineered and pre-established locations for weep holes.

In the present sense, to be engineered means to be built and positioned as a result of analysis, design, and modern precision manufacturing. The foam patches, by their location on the nail fin of the delivered window frame, direct the installer as to exactly where the bead of sealant is to go, and by implication, where it should not go, so that when the window is pushed into position, the thick sealant will not be spread into the weep hole but be resisted by the sides of the patches. Engineered manufacturing avoids and limits sealant spread into a weep hole and helps to assure a precision seal and the reliable operation of the weep holes for the windows, and it reduces installation time and errors. Moreover, the foam patches may be sized for the local climate, such as being made with a larger cross-section for tropical or semi-tropical locations.

These and other features of the present apparatus and method will be readily apparent to those skilled in the art of window manufacture and design from a careful reading of the Detailed Description that follows.

BRIEF DESCRIPTION OF THE DRAWINGS

In the figures.

DETAILED DESCRIPTION

Figure 1:
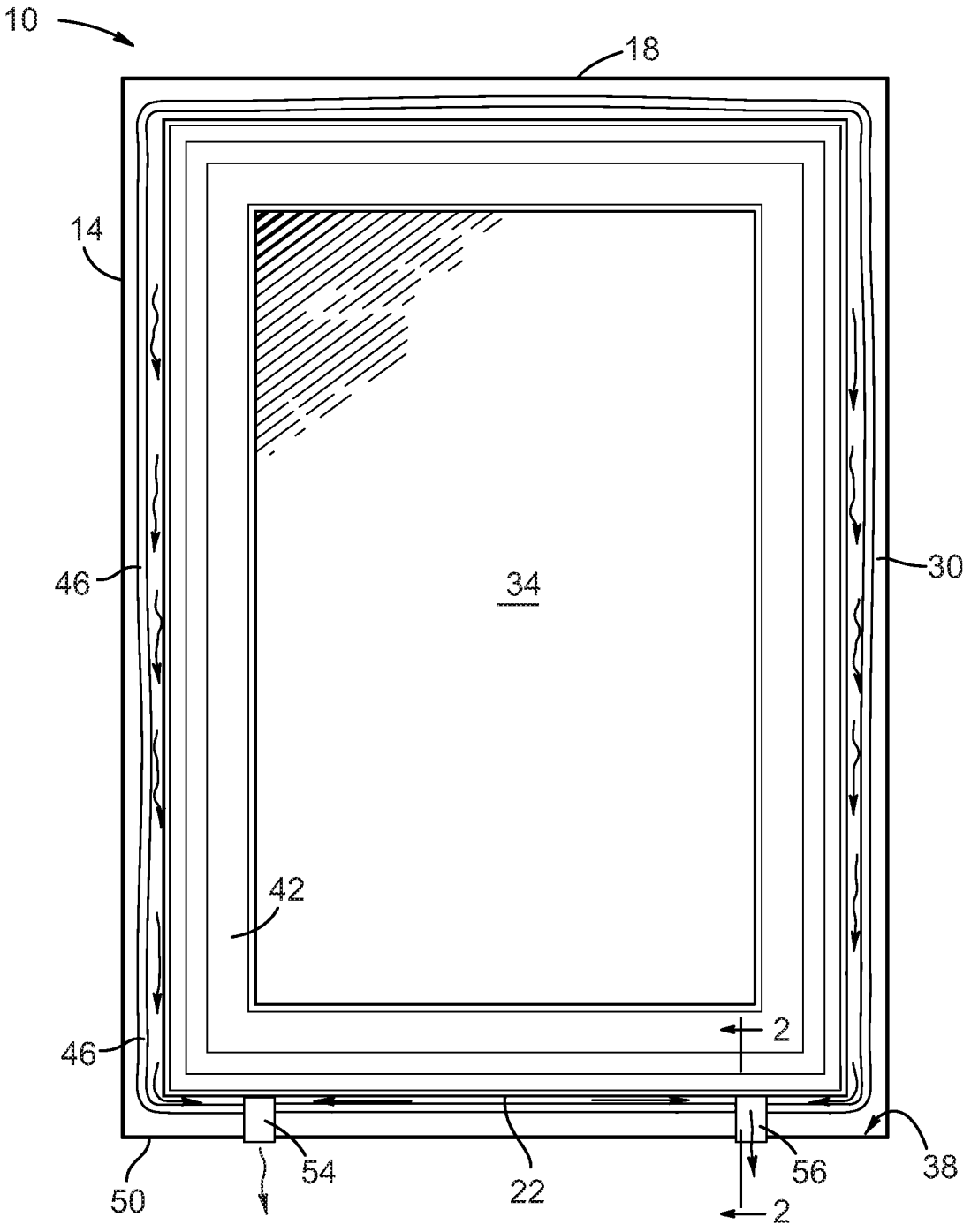
FIG. 1 is front view of a manufactured window frame with window including a sealant bead and two foam patches that define two weep holes, according to an aspect of the disclosure.

Referring now to the figures, FIG. 1 shows the inside of a window 10. Window 10 has a window frame 14 that includes a head 18 and a sill 22 and a left jamb 26 and a right jamb 30. Inside window frame 14, there is a window pane 34; the outside of window frame 14 carries a nail fin 38 that is to be nailed to the outside of the framing around window 10. Channel 42 may collect water from outside the window as a result of rain, melted snow, window washing, and condensation. Collected water may drip downward through channel 42 inside window frame 14 toward sill 22.

A bead 46 of sealant is applied to keep the draining water away from the edge 50 of nail fin 38. At the bottom of window frame 14, nail fin 38 carries at least one and preferably two foam patches 54, 56, that are bounded on the left and right by bead 46. Water that drains, on reaching foam patches 54, 56, is wicked into the foam and then drains naturally by a combination of gravity, wicking, surface tension and pressure from the water coming behind it.

Importantly, the open cell foam of foam patches 54, 56, prevents many insects, such as bees, wasps, hornets and flies from entering the interior of window 10 and the window frame of the house.

Also of importance is that the design, materials, placement, and application of the foam patches 54, 56, are engineered as part of the engineered window frame. Instead of depending on installers to leave gaps in the sealant bead at the right places, foam patches 54, 56, are designed in size, shape, materials, numbers, and locations and then applied to nail fin 38 during manufacture. Furthermore, foam patches 54, 56, can be customized just as the thermal efficiency, sound-proofing, ultraviolet and infrared resistance, and scratch-resistance of window pane 34 may be customized for the environment of the locale of expected use.

The foam inside foam patches 54, 56, is preferably open cell foam with a first protective cover 72 adhered to one face and a second protective cover 74 adhered to the opposing face. Protective cover 72 may be peeled from an adhesive layer 76; second protective cover 74 may be peeled from an adhesive layer 78. Foam patches 54, 56, may be 5 centimeters (2 inches) high and 2½ centimeters (1 inch) wide and 2-3 millimeters thick. The precise dimensions will depend on the application and a modest amount of experimentation well within the capability of a window manufacturer.

Figure 2:
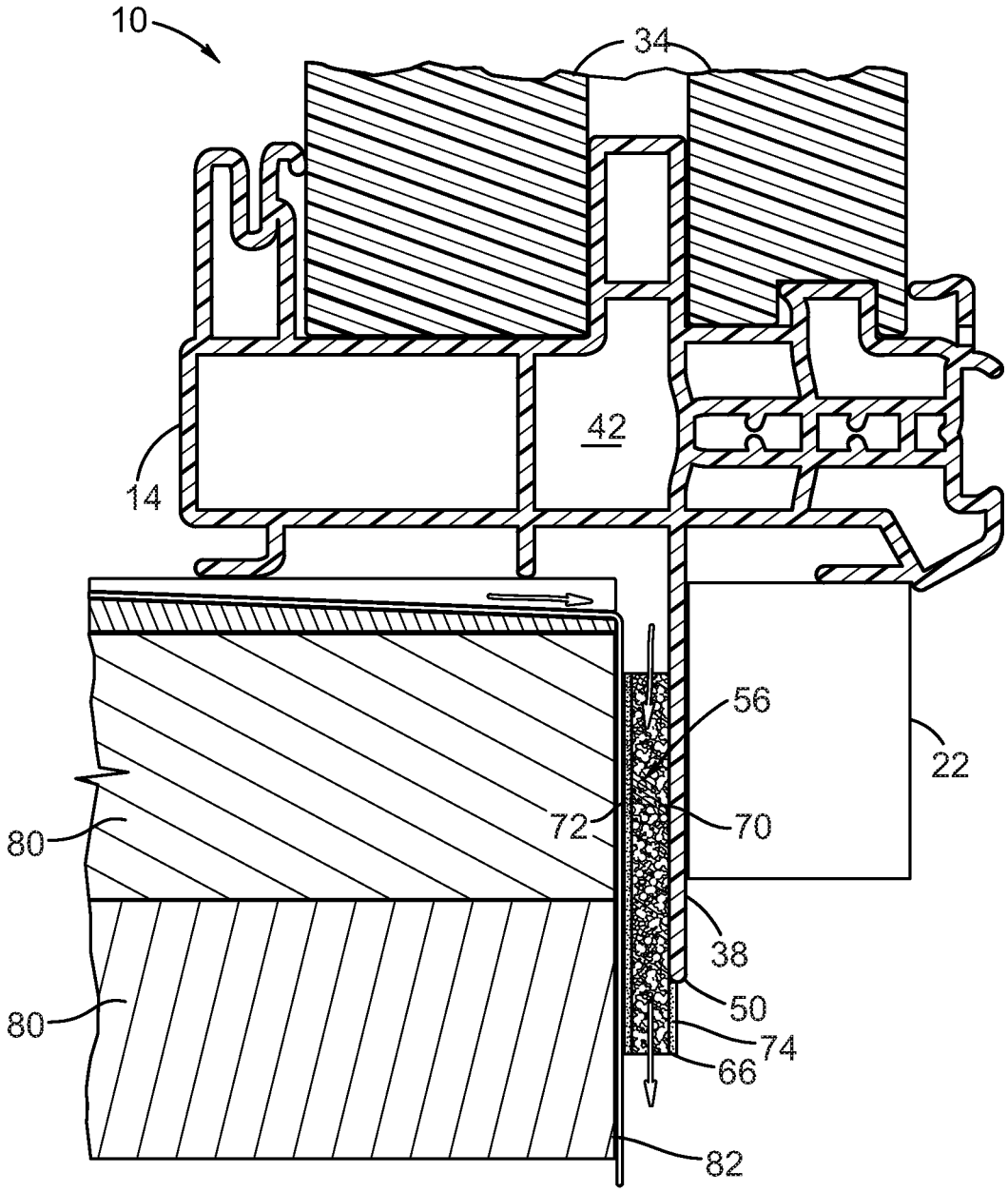
FIG. 2 is a side, cross-sectional view of a representative window frame showing the path of rainwater below the window frame to an open cell foam patch adhered to the nail fin, according to an aspect of the disclosure.
Figure 3A:
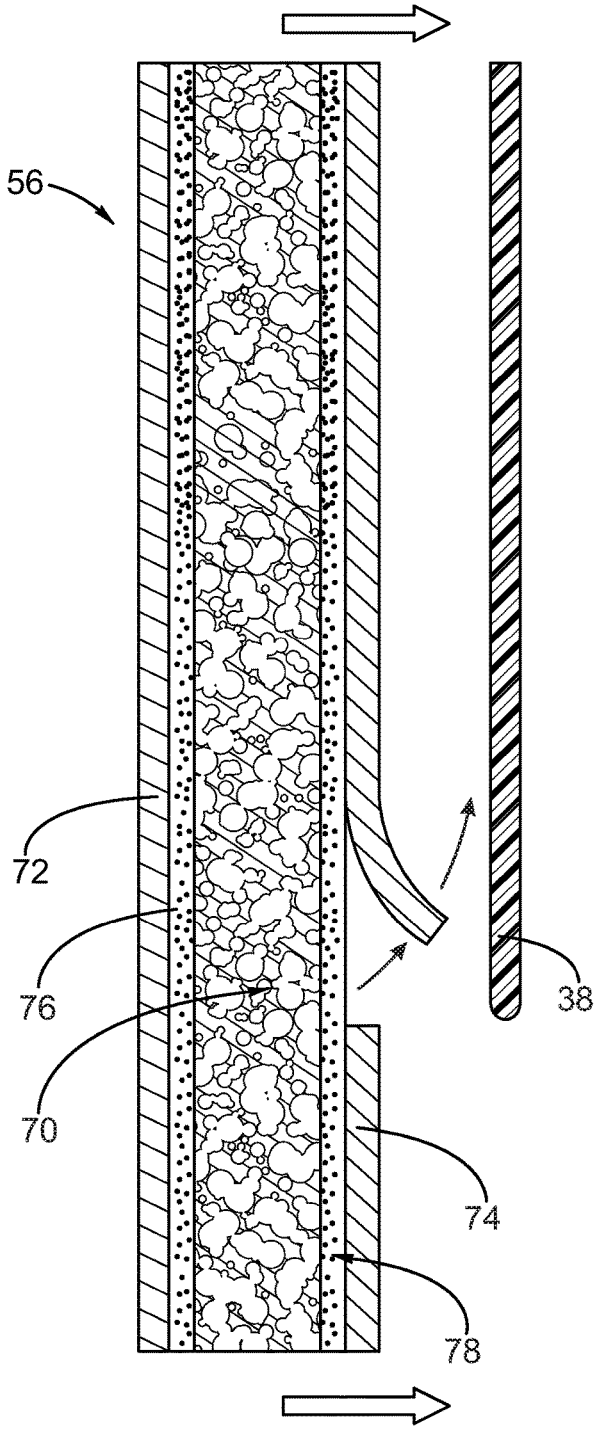
FIG. 3A is a cross-sectional view of a portion of FIG. 2 showing the foam patch with one protective cover being peeled away in preparation for adhering that side of the foam patch to the nail fin.
Figure 3B:
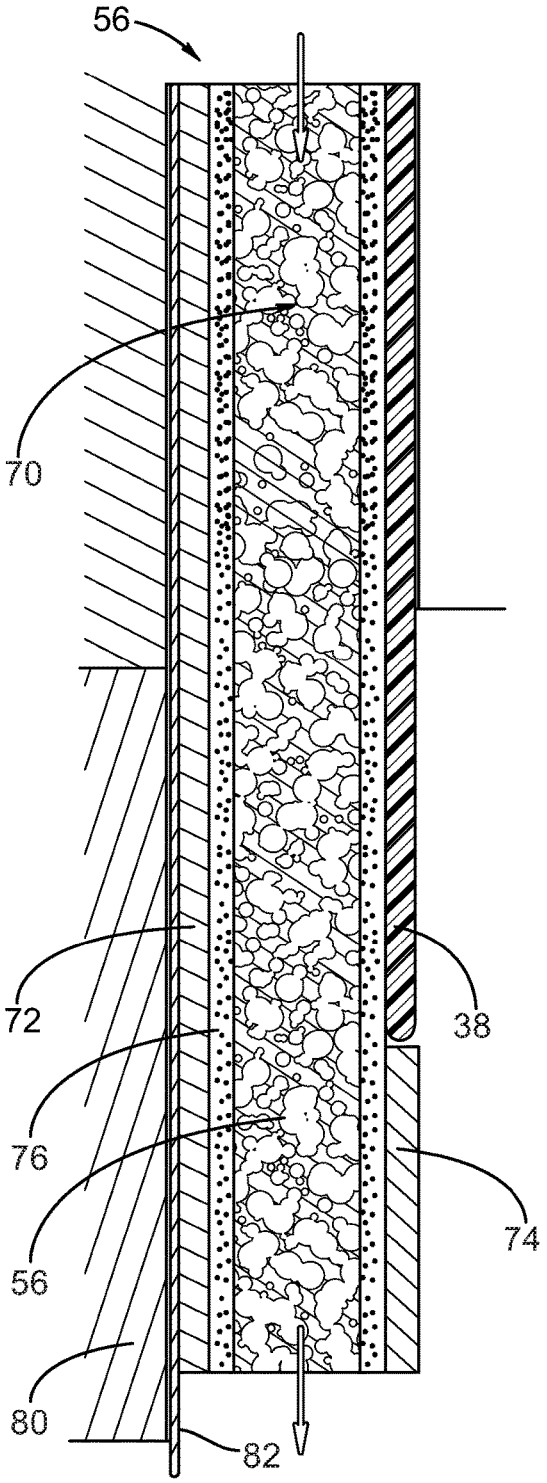
FIG. 3B shows the cross sectional view of FIG. 3A, with one protective cover removed and the adhesive of that side of foam patch adhered to the nail fin, according to an aspect of the disclosure.

In installation, and as shown in FIG. 2 and by comparing FIGS. 3A and 3B, window 10 is installed by applying the foam patches 54, 56, on nail fin 38 approximately 7-8 centimeters from left jamb 26 and 7-8 centimeters from right jamb 30, respectively. At the job site, bead 46 of sealant is run horizontally and directly between top edges 66, 68, of foam patches 54, 56. A second bead of sealant is run from the left side of foam patch 54 to the right side of foam patch 56 around window frame 14 on the same side of nail fin 38 as foam patches 54, 56, to seal against water intrusion into the framing of the building.

In manufacture, the components of window frame 14 are manufactured by extrusion or milling and then assembled and fastened. Foam patches 54, 56 are placed on nail fin 38, affixed a short distance such as 7-8 cm from left jamb and 7-8 cm from the right jamb, respectively. The distance between them may depend on the width of the window 10.

FIG. 2 shows a cross sectional view of window frame 10 with pane 34 (double pane) as indicated at the bottom of FIG. 1. Window frame 10 is extruded of polyvinyl chloride and rests on sill 22. Nail fin 38 has been nailed or screwed to sill 22. Foam patch 56 is applied to nail fin 38, which may be done prior to shipping window frame 10 to the job site, by removing protective cover 74 to expose adhesive 78. In construction, the rough opening has been framed in with wood 80 and covered with waterproof tape 82

Those familiar with window manufacturing and installation will appreciate that changes and substitutions may be made in the foregoing description of the improved window without departing from the spirit and scope of the disclosure.

What is claimed is:

1. A frame for a building intrusion, comprising:

(a) a frame defined by a head, a left jamb, a right jamb opposing said left jamb, and a sill opposing said head;

(b) at least one pane in said frame;

(c) at least one open cell foam patch on said sill defining at least one weephole, said open cell foam patch having a first side and an opposing second side; and (d) a bead of sealant carried on said frame extending around said pane in said window frame from said first side of said at least one open cell foam patch on said sill to said left jamb, to said head, to said right jamb and to said sill and then to said opposing side of said at least one open cell foam patch on said sill, said at least one foam patch defining said at least one weep hole, wherein said bead of sealant on said frame leads water to flow along said bead to said open cell foam patch wherein said water passes to the exterior of said frame without allowing ingress of insects;

channels in said window frame, said channels communicating with said at least one open cell foam patch inside said bead of sealant so that water in said channels drains through said at least one foam patch.

2. The window of claim 1, wherein said window frame includes a nail fin, and wherein said bead of sealant and said at least one open cell foam patch are carried by said nail fin.

3. The window of claim 1, wherein said at least one open cell foam patch is two open cell foam patches.

4. The window of claim 3, wherein said two open cell foam patches are spaced apart.

5. The window of claim 3, wherein said two open cell foam patches have a bead of sealant between them.

6. A method of installing a window with built in seepage, said method comprising:

(a) providing a window frame including a nail fin;

(b) applying at least one open cell foam patch to said nail fin, said at least one open cell foam patch having a first side and a second side;

(c) applying a bead of sealant running to said first side of said at least one open cell foam patch and from said second side of said at least one open cell foam patch along said nail fin, wherein said bead of sealant does not traverse said at least one open cell foam patch;

wherein said bead of sealant on said frame leads water to flow along said bead to said open cell foam patch wherein said water passes to the exterior of said frame without allowing ingress of insects; and (d) pressing said bead of sealant, and said at least one open cell foam patch onto framing of a building.

7. The method of claim 6, wherein said window frame includes a left jamb and a right jamb, and wherein said method further comprises the step of placing a first open cell foam patch of said at least one open cell foam patch close to said left jamb and a second open cell foam patch of said at least one open cell foam patch close to said right jamb.

8. The method of claim 6, wherein said window frame includes a left jamb and a right jamb, and wherein said method further comprises the step of applying said bead of sealant between said first open cell foam patch and said second open cell foam patch, and applying a second bead of sealant running from said first open cell foam patch to said second open cell foam patch running from said second side of said first open cell foam patch to said first side of said second open cell foam patch via said left jamb and said right jamb.

* * * * *